US005599401A

United States Patent [19]

Brosky et al.

[11] Patent Number: 5,599,401

[45] Date of Patent: Feb. 4, 1997

[54] PORTABLE, HAND-HELD, SELF-CONTAINED MULTI-SURFACE, HYDRO-CLEANING APPARATUS

[75] Inventors: Andrew P. Brosky, Waldorf, Md.; Louis A. Grandelis, Fort Lee, N.J.; Mark E. Radcliffe, Waldorf, Md.

[73] Assignee: Jancar Industries, Inc., Waldorf, Md.

[21] Appl. No.: 285,625

[22] Filed: Aug. 4, 1994

[51] Int. Cl.[6] ..... B08B 5/04; B08B 3/00; B08B 7/04

[52] U.S. Cl. ..... 134/21; 134/34; 134/37

[58] Field of Search ..... 134/21, 37, 34; 15/344, 340.1, 340.3, 340.4, 383, 395

[56] References Cited

U.S. PATENT DOCUMENTS

| | | | |
|---|---|---|---|
| 1,869,730 | 8/1932 | Antle | 15/395 |
| 3,946,459 | 3/1976 | Armstrong | 15/377 |
| 4,776,058 | 10/1988 | Garner et al. | 15/320 |
| 4,788,738 | 12/1988 | Monson et al. | 15/320 |
| 4,798,613 | 1/1989 | Hetherington et al. | 55/52 |
| 4,920,608 | 5/1990 | Hult et al. | 15/339 |
| 4,924,550 | 5/1990 | Wu | 15/328 |
| 4,930,178 | 6/1990 | Monson et al. | 15/320 |
| 5,005,252 | 4/1991 | Steiner et al. | 15/339 |
| 5,074,007 | 12/1991 | Mai et al. | 15/344 |
| 5,245,726 | 9/1993 | Rote et al. | 15/339 |
| 5,289,610 | 3/1994 | Monson | 15/320 |
| 5,379,483 | 1/1995 | Pino | 15/323 |
| 5,400,543 | 3/1995 | Ideker | 43/139 |

*Primary Examiner*—Jan H. Silbaugh
*Assistant Examiner*—Robin S. Gray

[57] ABSTRACT

A method for attaining increased suctioning power for taking up liquid debris and/or cleaning fluid directly into the impeller of a portable, hand-held, self-contained multi-surface hydro-cleaning apparatus, and for retaining the liquid debris in a collection chamber without leakage. The hydro-cleaning apparatus comprises an impeller, a deflector housing, a collection tank, an exhaust vent, and a porous filter. The method comprises the steps of creating a suction path with the impeller and directing air and the liquid debris into the cleaning apparatus along the suction path. Air and debris are suctioned directly into the impeller without obstruction or deflection. Upon reaching the impeller, the air and debris are drawn directly through the impeller and then deflected downward by the deflector housing into the collection tank. Both gravity and air flow dynamics act to retain incoming liquid debris in the collection tank while allowing the rush of incoming air to flow upward to the top of the collection tank where the air passes through the porous filter to escape through the exhaust vent. Liquid debris which may be splashed during the cleaning process and thus enabled to reach the exhaust vent, is absorbed by the porous filter to prevent unwanted transfer of liquid debris beyond the confines of the collection tank. Upon completion of the cleaning procedure, the collection tank can be easily detached and emptied.

13 Claims, 3 Drawing Sheets

PORTABLE, HAND-HELD, SELF-CONTAINED MULTI-SURFACE, HYDRO-CLEANING APPARATUS

BACKGROUND OF THE INVENTION

This invention relates to portable hand-held surface cleaners and, more particularly, to a self-contained, portable, hand-held, multi-surface, rechargeable hydro-cleaning apparatus for solid and liquid debris vacuum cleaning applications having an increased efficiency and liquid containment capability over prior art designs.

DESCRIPTION OF THE RELEVANT ART

Portable, battery-powered, hand-held vacuum cleaning devices have become increasingly popular due to their small size and self-contained nature. Such cleaning devices may be used for a variety of applications in the home, office, car or other location having small areas that may be difficult to access. Often a portable, battery-powered, hand-held device is the only practical answer to cleaning requirements where traditional canister, upright or shop type vacuum cleaners are simply too cumbersome.

Some examples of cordless, portable vacuum cleaners are shown in U.S. Pat. No. 5,005,252 to Steiner et al., U.S. Pat. No. 4,788,738 to Monson et al., U.S. Pat. No. 4,798,613 to Hetherington et al., U.S. Pat. No. 4,920,608 to Hult et al., and U.S. Pat. No. 4,930,178 to Monson et al.

Two problems have been consistently faced in the prior art, and have not heretofore been solved. The first problem has centered on obtaining sufficient pick-up power in portable cleaning devices to enable pick-up of spilled liquids and heavy particles. The second problem arises in the pick-up of liquid debris and concerns the need to keep such liquid debris out of the suctioning mechanism and to thereafter contain this liquid debris within the cleaning device.

A typically constructed portable, hand-held vacuum cleaning device includes an impeller-type element, driven by a motor, for forcibly drawing air and debris into the cleaning device. In theory, the debris is captured in a collection tank, often as a result of having passed through an involved sequence of deflector blades which impede the progress of the debris particles to such an extent that the weight of the particles causes them to settle downward, while the airstream continues to flow. In reality, this often does not work, as the air/debris remains airborne and passes through the impeller. Alternatively, filters have been employed which block the debris particles while allowing the air to pass through the filters. Air drawn into the cleaning device is then exhausted from the cleaning device, hopefully without air-entrained debris, through an exhaust vent.

Filters or some form of deflecting mechanism may be used to impede the debris particles but such filters result in a loss of the efficiency and effectiveness of the air flow path through the portable cleaning devices and do not trap all debris in the collection tank. As a result, portable cleaning devices have been largely unable to generate the suctioning power demonstrated by larger units.

Taking up liquid debris with a portable cleaning device and retaining these particles within the device following pick-up has been a challenge with several fronts. First is the problem of preventing such liquid debris from entering the suctioning mechanism or impeller, and subsequently the motor mechanism. Second is the problem of binding the liquid debris particles sufficiently, once they have been taken in, such that these particles do not accompany the air as it passed out of the cleaning device through the exhaust vent. While this problem also exists with solid debris particles, liquids by their very nature are more easily entrained and transported in an airflow than are solids.

Addressing the first problem, the prior art has focused on diverting the mixture of air and debris drawn into a given cleaning device away from the impeller. U.S. Pat. No. 4,776,058 to Garner et al. relies upon baffles and a convoluted passageway to deflect liquid and prevent its introduction into the fan mechanism. In Monson et al., liquids are prevented from flowing into the vacuum blower by a centrifugal separator, further protected by a separator guard in the form of a splatter screen. U.S. Pat. No. 4,798,613 to Hetherington et al. discloses a portable vacuum surface cleaning apparatus in which liquid and debris are prevented from entering the blower assembly through a combination of a convoluted passageway between the surface engaging inlet orifice and the blower, and diverting baffles for deflecting the liquid and debris into the recovery chamber during traversal of this passageway. In U.S. Pat. No. 4,920,608 to Hult et al., separation of incoming debris and air is accomplished using a filtering system and a pair of deflectors. U.S. Pat. No. 4,930,178 to Monson et al. also discusses the use of a deflection conduit and two drift eliminator blades to prevent liquid or solid matter from entering the blower motor. U.S. Pat. No. 5,005,252 to Steiner et al. discloses a battery-powered portable wet/dry vacuum cleaner in which debris entrained in the incoming air is deflected from the air duct inlet through the use of deflectors.

The second problem, retaining the liquid once taken in, is related to the first in that attempted solutions to both have relied on similar mechanisms including deflectors and baffles to slow the airstream coming into the cleaning device so that liquid particles will "drop out" and settle in the collection tank. The prior art does not make allowance for fluid motion control made necessary by the rocking of the apparatus as naturally occurs during a vacuuming procedure. Nor does the prior art address the subsequent transfer of liquid particles from the reservoir already contained in the collection tank back into the airstream due to such rocking and related agitation. Also not addressed by the prior art is a means whereby liquid particles that have simply not "dropped out" of the airstream at the intended time can be stopped short of exiting the cleaning device through the exhaust vent and, potentially, spraying onto the user.

OBJECTS OF THE INVENTION

A general object of the invention is providing an improved portable, hand-held, self-contained, battery-powered, multi-surface hydro-cleaning apparatus which overcomes the aforementioned deficiencies in the prior art.

Another object of the invention is providing a portable, hand-held hydro-cleaning apparatus with sufficient pick-up power to take up liquids and heavy particles.

An additional object of the invention is an improvement to existing technology through an innovative design allowing not only solid but also liquid debris to be drawn directly and intentionally into the impeller, without obstruction, producing maximum suctioning power.

A further object of the invention is a portable, hand-held, battery-powered, self-contained hydro-cleaning apparatus for extracting liquid debris from a multitude of surfaces and for preventing this liquid debris, once taken in, from exiting the hydro-cleaning apparatus through the exhaust vent.

SUMMARY OF THE INVENTION

According to the present invention, as embodied and broadly described herein, a portable, wall-mountable, hand-held multi-surface hydro-cleaning apparatus, using a rechargeable, battery-powered energy supply is provided. Alternatively, the portable, hand-held multi-surface cleaning apparatus may include an AC power adapter.

The portable, hand-held, multi-surface cleaning apparatus comprises an impeller having a plurality of blades, an impeller motor, a motor seal, a first switch, an on/off-switch button, a pick-up nozzle, a deflector housing, a collection tank, an exhaust vent, and a porous filter. The present invention also may include a clean-water tank, a cleaning-fluid hose, a spray pump, a spray-pump motor, a second switch, a spray-switch button, a spray-nozzle-junction hose, and a spray nozzle.

Air and debris are directed into the cleaning apparatus by the pick-up nozzle and drawn into a suction path created by the impeller. As used in this patent, "debris" is defined to include solids and/or liquids. As used in this patent, "hydro-debris" is defined to include moist or wet debris. Air and debris are suctioned directly into the impeller. Upon reaching the impeller, the air and debris are drawn directly through the impeller blades and then deflected downward by the deflector housing into the collection tank. Both gravity and the air flow dynamics within the collection tank act to retain incoming fluid and debris in the tank while allowing the rush of incoming air to flow upward to the top of the collection tank where the air passes through the porous filter to escape through the exhaust vent. In the event that water or other debris reaches the exhaust vent, there is insufficient suction remaining to actively pull the water, or debris, through the exhaust vent. Instead, the porous filter at the top of the collection tank absorbs the water and prevents splashing or other unwanted transfer of liquid beyond the confines of the collection tank.

For cleaning applications requiring a liquid cleaner, cleaning fluid can be added to the clean-water tank. As used in this patent, "cleaning fluid" is defined to include water, liquid detergent or other soap, or any equivalent fluid or combination of fluids. The spray motor powers the spray pump. The spray pump draws the cleaning fluid out of the clean-water tank through the cleaning-fluid hose. The cleaning fluid flows through the fluid cleaning hose, into the spray-nozzle-junction hose, and out the spray nozzle to wet the surface to be cleaned. The cleaning fluid is then drawn into the pick-up nozzle, possibly with other debris, as hydro-debris.

Upon completion of the cleaning procedure, the collection tank can be easily detached and emptied. The nozzle may also be detached for cleaning or to install a different attachment, such as, for example, a brush or a longer hose. The portable, handheld, multi-surface cleaning apparatus can be used to clean a variety of surfaces and is suited for cleaning small areas.

The present invention also includes a method of suctioning debris and hydro-debris into a cleaning apparatus using a pick-up nozzle, an impeller having a plurality of blades, an impeller motor, a deflector housing, and a collection tank. The method comprises the steps of spinning the impeller using the impeller motor to create suction; forcibly intaking air using the suction created by the spinning impeller to create a suction path; introducing solid and/or fluid particles as debris into the cleaning apparatus through the vacuum nozzle; conveying the debris inward along the suction path, drawing the debris directly into and through the impeller; deflecting, using the deflector housing, the debris passing through the plurality of blades, the debris moving downward responsive to gravity and air flow dynamics; and collecting the debris in the collection tank, located beneath the deflector housing.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1:
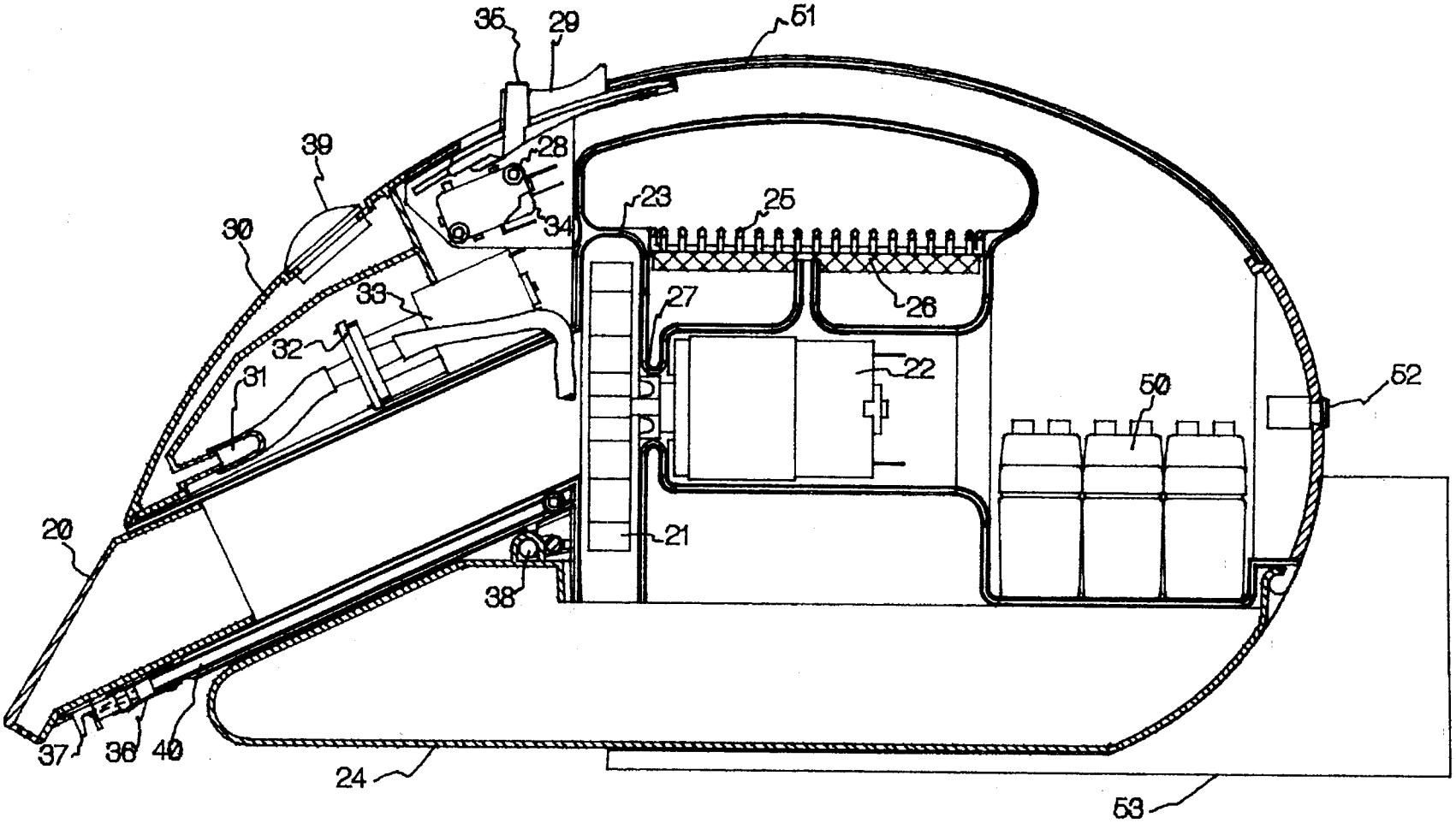
FIG. 1 illustrates a cross-section of the present invention.

Reference now is made in detail to the present preferred embodiments of the invention, examples of which are illustrated in the accompanying drawings, wherein like reference numerals indicate like elements throughout the several views.

In the exemplary arrangement shown in FIG. 1, the portable, hand-held, multi-surface cleaning apparatus of the present invention comprises an impeller 21, an impeller motor 22, a motor seal 27, a first switch 28, an on/off-switch button 29, a pick-up nozzle 20, a deflector housing 23, a collection tank 24, an exhaust vent 25, and a porous filter 26. The present invention may also include a clean-water tank 30, a first cleaning-fluid hose 31, a spray pump 32, a spray-pump motor 33, a second switch 34, a spray-switch button 35, a second cleaning-fluid hose 40, a spray-nozzle-junction hose 36, and a spray nozzle 37.

The impeller 21 is operatively coupled to the impeller motor 22 through the motor seal 27. The first switch 28 is electrically coupled to the impeller motor 22. The on/off-switch button 29 is electrically coupled to the first switch 28. The pick-up nozzle 20 is located on the intake side of the impeller 21. The deflector housing 23 is located partially around and on the exhaust side of the impeller 21. The collection tank 24 is located beneath the impeller 21. The exhaust vent 25 is at the top of the collection tank 24. The porous filter 26 is mounted to the bottom inside surface of the exhaust vent 25.

As illustratively shown in FIG. 1, the clean-water tank 30 is located above the pick-up nozzle 20. This location is not required but is used as an example in a preferred embodiment. The first cleaning-fluid hose 31 is connected at a first end to the clean-water tank 30. The second end of the first cleaning-fluid hose 31 is connected to the intake side of the spray pump 32. The spray-pump motor 33 is operatively coupled to the spray pump 32. The second switch 34 is electrically coupled to the spray-pump motor 33. The spray-switch button 35 is electrically coupled to the second switch 34. The second cleaning-fluid hose 40 is connected at a first end to the exhaust side of the spray pump 32. The spray-nozzle-junction hose 36 is connected at a first end to a second end of the second cleaning-fluid hose 40. The spray nozzle 37 is connected to a second end of the spray-nozzle-junction hose 36.

The impeller 21 has a plurality of blades and creates suction by spinning. The impeller motor 22 powers the impeller 21. The first switch 28 activates the impeller motor 22. The on/off-switch button 29 activates the first switch 28. The pick-up nozzle 20 passes over the surface to be cleaned, directing air and debris into a suction path created by the impeller 21. The deflector housing 23 deflects the air and debris drawn into and through the impeller 21. The collection tank 30 collects debris drawn into the impeller 21 and deflected by the deflector housing 23. The exhaust vent 25 vents the air that was used to draw in the debris. The porous filter 26 captures errant debris particles and contains these particles within the collection tank 24.

The clean-water tank 30 stores a volume of cleaning fluid which can be water, cleaning solution or other equivalent liquid. As used in this patent, "cleaning fluid" is defined to include water, cleaning solution, liquid detergent or soap, or other equivalent liquid of combination of liquids.

The first cleaning-fluid hose 31 directs the cleaning fluid from the clean-water tank 30 to the spray pump 32. The spray pump 32 draws the cleaning fluid out of the clean-water tank 30. The spray-pump motor 33 powers the spray pump. The second switch 34 activates the spray-pump motor 33. The spray-switch button 35 activates the second switch 34. The second cleaning-fluid hose 40 directs the cleaning fluid from the spray pump 32 to the spray-nozzle-junction hose 36. The spray-nozzle-junction hose 36 connects the second cleaning-fluid hose 40 to the spray nozzle 37. The spray nozzle 37 controls the flow of cleaning fluid and sprays the cleaning fluid onto the surface to be wetted and cleaned.

Referring to FIG. 1, air and debris are drawn by the pick-up nozzle 20 into a suction path created by the impeller 21. The impeller 21 is powered by the impeller motor 22. The impeller motor 22 is sealingly separated from the impeller 21 by a motor seal 27. The impeller motor is activated by the first switch 28. The first switch 28 is activated by the on/off-switch button 29. The apparatus is powered by at least one battery 50. Alternatively, the apparatus may operate on AC voltage using an AC power adapter 52.

Air and debris are drawn directly into and through the impeller 21 responsive to suction created by the impeller 21. As used in this patent, "debris" is defined to include solids and/or liquids. As used in this patent, "hydro-debris" is defined to include moist or wet debris. Once through the impeller 21, the air and debris are deflected downward by the deflector housing 23 into the collection tank 24. Debris settles into the collection tank 24 while the air continues to flow upward and out of the apparatus through the exhaust vent 25. A porous filter 26 prevents any errant debris particles from exiting the collection tank 24 with the air.

For cleaning applications requiring a liquid cleaner, cleaning fluid can be added to the clean-water tank 30 through the clean-water-tank lid 39. The spray-switch button 35 activates the second switch 34. The second switch 34 activates the spray-pump motor 33. The spray-pump motor 33 powers the spray pump 32. The spray pump 32 draws the cleaning fluid out of the clean-water tank 30 through the first cleaning-fluid hose 31 and into the second cleaning-fluid hose 40. The cleaning fluid flows through the second cleaning-fluid hose 40, into the spray-nozzle-junction hose 36, and out the spray nozzle 37 onto the surface to be cleaned. The cleaning fluid is then drawn into the pick-up nozzle, possibly with other debris, as hydro-debris.

When the collection tank 24 becomes full or the cleaning procedure is completed, the collection tank 24 can be released from the apparatus and emptied using the collection-tank latch 38. The hydro-cleaning apparatus may also include means for mounting on a wall such as a wall-mounting bracket 53.

The present invention also includes a method of suctioning debris and hydro-debris into a cleaning apparatus using a pick-up nozzle, an impeller having a plurality of blades, an impeller motor, a deflector housing, and a collection tank. The method comprises the steps of spinning the impeller using the impeller motor to create suction; forcibly intaking air using the suction created by the spinning impeller to create a suction path; introducing at least one of solid debris and fluid debris as debris into the cleaning apparatus through the vacuum nozzle; conveying the debris inward along the suction path, drawing the debris directly into and through the impeller; deflecting, using the deflector housing, the debris passing through the plurality of blades, the debris moving downward responsive to gravity and air flow dynamics; and collecting the debris in the collection tank, located beneath the deflector housing.

By way of example, when using the present invention for the clean-up of a liquid spill from carpet using the liquid cleaner, the user pours cleaning fluid into the clean-water tank 30 through the clean-water-tank lid 39. The user then picks up the hydro-cleaning apparatus by the handle 51, carries it to the area to be cleaned, and activates the hydro-cleaning apparatus by sliding the on/off-switch button 29. The on/off-switch button 29 activates the first switch 28 which activates the impeller motor 22. The impeller motor 22 spins the impeller 21 which, by spinning, creates suction. The user then places the pick-up nozzle 20 against the carpet to be cleaned, passing it back and forth over the surface in the usual vacuuming manner. Hydro-debris caught in the carpet is drawn into the pick-up nozzle 20 along a suction path toward the impeller 21. The hydro-debris passes through the impeller 21, is deflected against the deflector housing 23, and drops into the collection tank 24.

Once the bulk of the hydro-debris has been extracted from the carpet, the user activates the spray mechanism by pressing the spray-switch button 35. The spray-switch button 35 activates the second switch 34. The second switch activates the spray-pump motor 33. The spray-pump motor 33 activates the spray pump 32. The spray pump 32 draws cleaning fluid from the clean-water tank 30 through the first cleaning-fluid hose 31 and into the second cleaning-fluid hose 40. The cleaning fluid then passes through the spray-nozzle-junction hose 36 and out of the hydro-cleaning apparatus through the spray nozzle 37.

Following application of the cleaning fluid to the carpet to the cleaned, the user continues passing the pick-up nozzle back and forth over the carpet in the usual vacuuming manner. The spray mechanism may be activated repeatedly for continued discharge of cleaning fluid. The cleaning fluid subsequently is drawn into the hydro-cleaning apparatus in the same manner as was just described for the hydro-debris, passing through the impeller 21, against the deflector housing 23, and into the collection tank 24.

Upon completion of the cleaning procedure, the user deactivates the hydro-cleaning apparatus by sliding the on/off-switch button 29. To empty the collection tank 24, the user releases the collection tank 24 from the apparatus using the collection-tank latch 38. The pick-up nozzle can also be detachable to allow for cleaning of the nozzle and to support installation of different attachments such as, for example, a longer hose, a brush attachment, etc. The means for detaching may be embodied as connecting sleeve 54 or equivalent connecting and disconnecting means.

Figure 2:
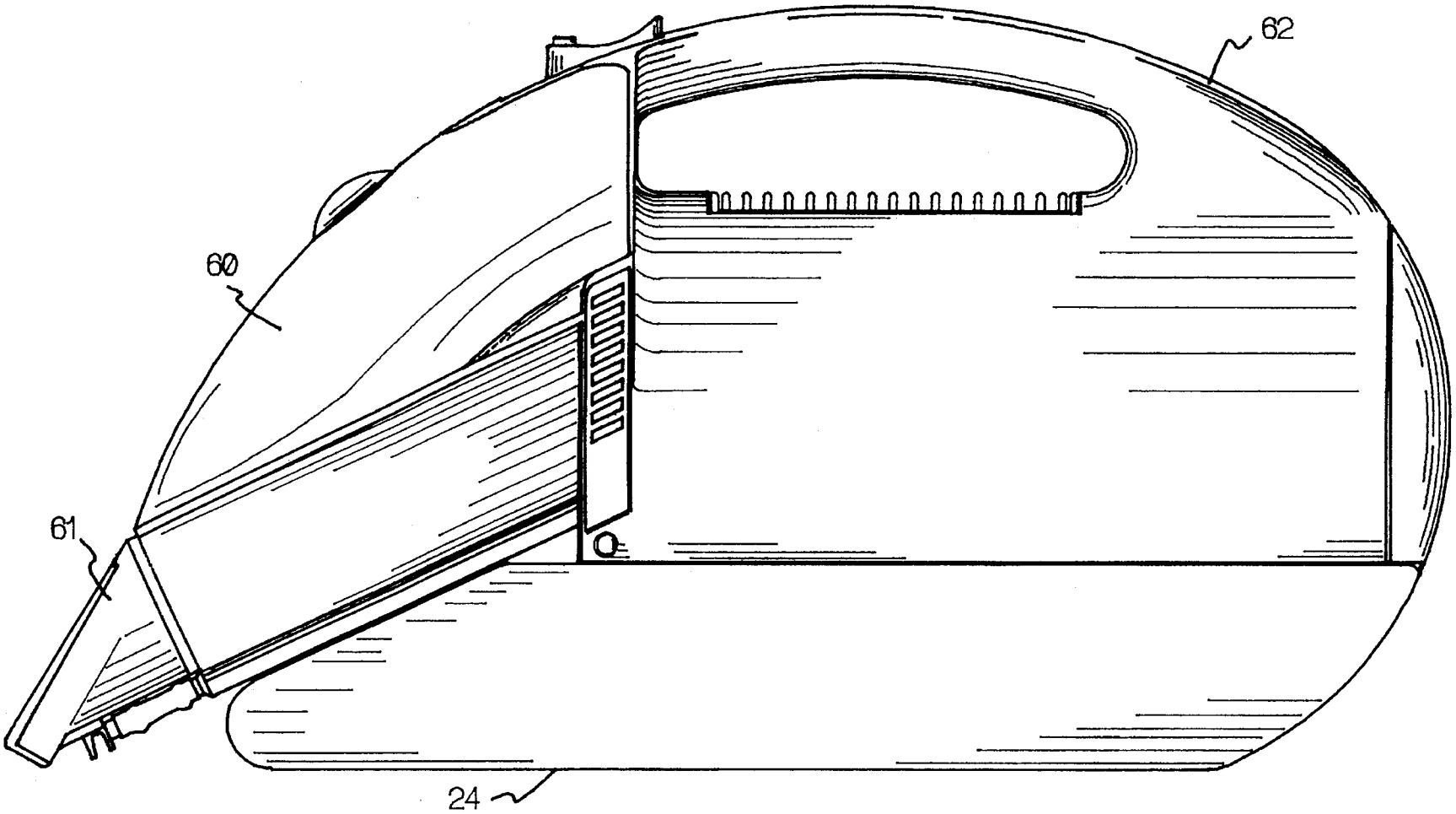
FIG. 2 shows the present invention divided into general functional areas.

FIG. 2 illustrates the present invention as conceptually divided into areas, with each area containing specific elements. The areas are the frontal region 60, the nozzle section 61, the body 62, and the collection tank 24. These areas are not a requirement of the present invention, but are used for purposes of illustration.

With the nozzle side of the current invention being the "front" and the battery area being the "back", the frontal region 60 is located above the nozzle section 61 and in front of the body 62. The nozzle section 61 is located in front of the body 62 and above the collection tank 24. The body 62 is located on top of the collection tank 24 and behind the frontal region 60 and the nozzle section 61. The collection tank 24 forms the base of the hydro-cleaning apparatus.

Referring to FIGS. 1 and 2, the frontal region 60 contains the clean-water tank 30, the first cleaning-fluid hose 31, the spray pump 32, the spray motor 33, the first and second switches 28, 34, the spray-switch button 35, and the on/off-switch button 29.

The nozzle section 61 contains the second cleaning-fluid hose 40, the spray-nozzle-junction hose 36, the spray nozzle 37, and the pick-up nozzle 20. The pick-up nozzle is detachable to allow for cleaning of the nozzle and to support installation of different attachments such as, for example, a longer hose, a brush attachment, etc.

The body 62 contains the handle 51, the impeller 21, the deflector housing 23, the impeller motor 22, the motor seal 27, the exhaust vent 25, the porous filter 26, and the battery 50.

The collection tank 24 is removably connected to the body by the collection-tank latch 38.

Figure 3A:
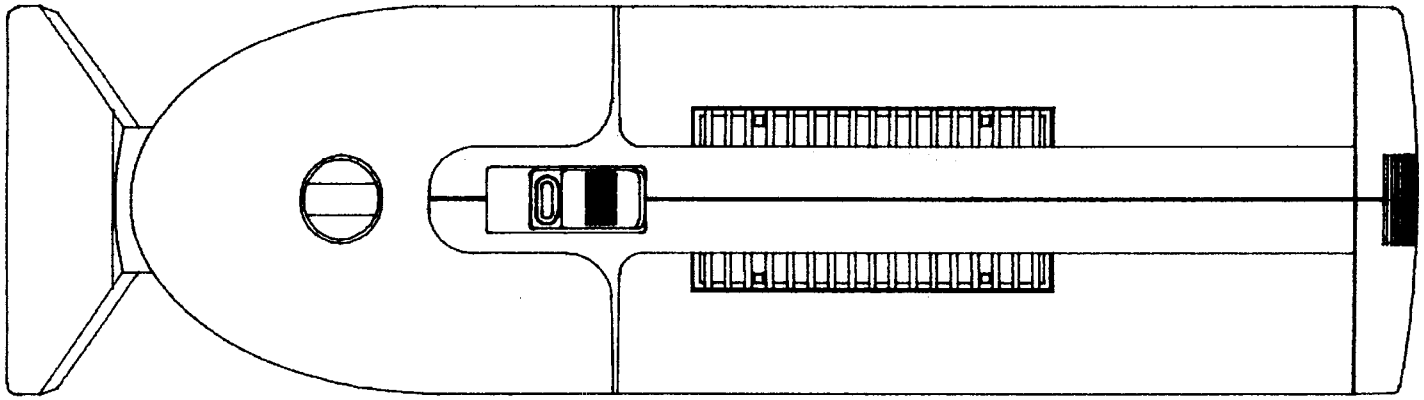
FIGS. 3A and 3B depict the size and shape of the collection tank relative to the remainder of the hydro-cleaning apparatus.
Figure 3B:
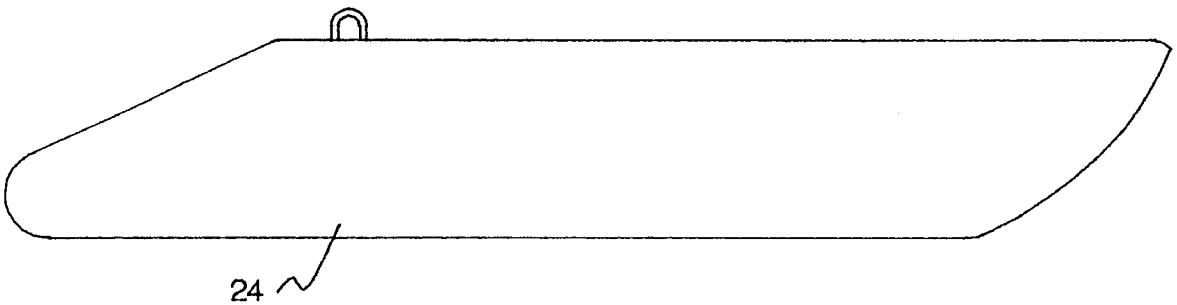

As shown in FIGS. 3A and FIG. 3B, the collection tank 24 is relatively long and wide. When comparing FIGS. 3A and 3B, the collection tank 24, as identified in FIG. 3B, is approximately the same length as the hydro-cleaning apparatus as a whole, shown in top view in FIG. 3A. The collection tank 24 is also approximately the same width as the hydro-cleaning apparatus as a whole, with the collection tank 24 underlying nearly the entire body and frontal region of the hydro-cleaning apparatus, shown in top view in FIG. 3A. By contrast with the length and width of the collection tank 24, the average height of the intended collection area is quite restricted. This relationship between length, width, and height results in the debris acting as ballast to render the hydro-cleaning apparatus "bottom heavy" and therefore resistant to tipping over. Unlike the prior art devices, the present invention actually becomes increasingly stable as the volume of debris increases. The length and width of the collection tank also enable the hydro-cleaning apparatus to hold a considerable volume without allowing the debris to approach the exhaust vent and porous filter. As a result, the shape of the collection tank is conducive to both stability of the hydro-cleaning apparatus and retention of the fluids within the collection tank.

While the height of the intended collection area of the collection tank is quite low, the "cathedral" center in the body area above the collection tank has a height approximately equal to that of the body of the apparatus, excluding the handle. The motor is mounted within this "cathedral" section. The motor is sealed off from the contents of the collection tank, being encased in an impermeable plastic material not open to the collection tank. The effective "blockage" created by the presence of the motor mount, combined with the height of the "cathedral", i.e., the distance from the base of the collection tank to the exhaust vent, serve to effectively prevent any debris from remaining entrained long enough to reach the exhaust vent. Any debris that were to reach the vent would be absorbed by the porous filter mounted to the bottom of the exhaust vent.

The current invention is also applicable as an improvement in a method of taking up and recovering debris from a surface using a surface cleaning apparatus having an impeller for forcibly intaking air as a means of suctioning debris from the surface into the surface cleaning apparatus for containment in a collection tank, the improvement comprising the steps of drawing incoming debris entrained in an airstream directly into the intake of the impeller; directing the debris through the impeller and downward into the collection tank located beneath the impeller; and collecting the debris in the collection tank, the debris moving downward and settling into the collection tank responsive to gravity and air flow dynamics. The increased volume in the tank area effectively lowers the air/debris velocity, thereby reducing the force with which the air/debris is drawn through the surface cleaning apparatus. Through reduced air/debris velocity, the debris has a greater opportunity, as mass overcomes velocity, to deposit in the collection tank. The lowered velocity in the collection tank also helps to prevent debris already captured from becoming airborne again while vacuuming and moving the surface cleaning apparatus.

The improvement just summarized provides maximum suctioning power by allowing incoming air and hydro-debris to be drawn directly into the suctioning mechanism without obstruction, an approach not previously suggested in the prior art for hydro-debris.

In addition to the steps recited, the improvement also comprises the steps of venting the air drawn into the collection tank with the debris through an exhaust vent in the top of the surface cleaning apparatus; and trapping and containing splashed hydro-debris using an absorbent filter mounted against a bottom of the exhaust vent. These steps solve the problem known in the prior art of hydro-debris escaping with the air through the exhaust vent and often onto the user. The absorbent filter allows air to pass while absorbing errant liquid particles.

While not shown or required by the preferred embodiment, a second auxiliary filter could be mounted at some level within the "cathedral" section of the collection tank but lower than the primary filter. This auxiliary filter would serve as a preliminary moisture blocker and splash guard and could be constructed of a more porous material than the primary filter. The enhanced porousness of the auxiliary filter would minimize air flow obstruction while still effectively damping fluid motion and transfer. The auxiliary filter could also be removable, upon removal of the collection tank, allowing the filter to be cleaned, wrung out, dried, replaced, etc.

It will be apparent to those skilled in the art that various modifications can be made to the portable, hand-held, self-contained, multi-surface, hydro-cleaning apparatus of the instant invention without departing from the scope or spirit of the invention, and it is intended that the present invention cover modifications and variations of the portable, handheld, self-contained, multi-surface, hydro-cleaning apparatus provided they come within the scope of the appended claims and their equivalents.

I claim:

1. A method of suctioning hydro-debris containing a quantity of liquid of up to sixteen fluid ounces into a portable, hand-held cleaning apparatus, and of retaining said hydro-debris and quantity of liquid within said portable, hand-held cleaning apparatus without external leakage, said portable, hand-held cleaning apparatus including a vacuum nozzle, an impeller having a plurality of blades, an impeller motor, a deflector housing, a non-porous collection tank, and an exhaust vent, comprising the steps of:

spinning the impeller using the impeller motor to create suction;

forcibly intaking air using the suction created by the spinning impeller to create a suction path;

introducing hydro-debris containing a quantity of up to sixteen fluid ounces of liquid into said portable, hand-held cleaning apparatus through the vacuum nozzle;

conveying the hydro-debris inward along the suction path;

drawing the hydro-debris directly into and through the impeller of said portable, hand-held cleaning apparatus;

deflecting, using the deflector housing, the hydro-debris passing through the plurality of blades, the hydro-debris moving downward responsive to gravity and air flow dynamics, while venting the forcibly intaked air upward and through the exhaust vent; and containing the hydro-debris without leakage in the non-porous collection tank, located beneath the deflector housing, at a bottom of said portable, hand-held cleaning apparatus.

2. A method of suctioning at least two fluid ounces of liquid as a volume of liquid into a hand-held, battery-operated cleaning apparatus, said hand-held, battery-operated cleaning apparatus including an impeller having a plurality of blades, a non-porous collection tank for retaining the volume of liquid, an impeller motor sealingly separated from the impeller and from the non-porous collection tank, and an exhaust vent, comprising the steps of:

spinning the impeller using the impeller motor to create suction;

forcibly intaking air using the suction created by the spinning impeller to create a suction path;

introducing the volume of liquid into said hand-held, battery-operated cleaning apparatus;

conveying the volume of liquid inward along the suction path toward the spinning impeller;

drawing the volume of liquid directly into the spinning impeller;

passing the volume of liquid directly through the spinning impeller; and collecting the volume of liquid in the non-porous collection tank, located beneath the impeller, the volume of liquid moving downward and settling into the non-porous collection tank responsive to gravity and air flow dynamics while venting the forcibly-intaked air upward and through the exhaust vent.

3. In a method of taking up and recovering hydro-debris, with said hydro-debris including a quantity of fluid of up to twenty fluid ounces, from a surface using a portable, hand-held surface-cleaning apparatus, said portable, hand-held surface-cleaning apparatus including an impeller having an intake for forcibly intaking air as a means of suctioning said hydro-debris from the surface into said portable, hand-held surface-cleaning apparatus for splash-controlled containment in a non-porous collection tank located at a bottom of said portable, hand-held surface-cleaning apparatus, and an exhaust vent, the improvement comprising the steps of:

drawing said hydro-debris entrained in an airstream directly into the intake of the impeller;

directing said hydro-debris and airstream through the impeller and downward into the non-porous collection tank located beneath the impeller; and collecting said hydro-debris, including the quantity of fluid of up to twenty fluid ounces, in the non-porous collection tank, said hydro-debris moving downward and settling into the non-porous collection tank responsive to gravity and air flow dynamics, while venting the airstream upward and through the exhaust vent.

4. The method as set forth in claim 3 further comprising the steps of:

moving said portable, hand-held surface-cleaning apparatus back and forth while drawing said hydro-debris, causing oscillation of the quantity of fluid collected within the non-porous collection tank and creating splashed hydro-debris;

venting the airstreams, directed into the non-porous collection tank with said hydro-debris, through said exhaust vent in a top of said portable, hand-held surface-cleaning apparatus; and trapping and containing the splashed hydro-debris using an absorbent filter mounted against a bottom surface of the exhaust vent.

5. A method of maximizing suction power for suctioning a quantity of fluid from a surface into a portable, hand-held cleaning apparatus using an impeller having a plurality of blades, a non-porous collection tank with a capacity for retaining at least ten fluid ounces, an impeller motor sealingly separated from the impeller and from the non-porous collection tank, and an exhaust vent, comprising the steps of:

spinning the impeller using the impeller motor to create suction;

forcibly intaking air using the suction created by the spinning impeller to create an unencumbered suction path;

exposing the quantity of fluid to the suction;

conveying the quantity of fluid inward along the unencumbered suction path directly toward the spinning impeller;

drawing the quantity of fluid directly into the spinning impeller;

passing the quantity of fluid directly through the plurality of blades of the spinning impeller; and collecting and retaining the quantity of fluid in the non-porous collection tank, located beneath the impeller, the quantity of fluid moving downward and settling into the non-porous collection tank responsive to gravity and air flow dynamics, while venting the forcibly-intaked air upward and through the exhaust vent.

6. A method of increasing suction for suctioning from one to twenty-four ounces of liquid as a quantity of fluid from a surface into a battery-operated, hand-held cleaning apparatus, and for retaining the quantity of fluid during movement of said battery-operated, hand-held cleaning apparatus without spillage of the quantity of fluid and without spillage of a subquantity of fluid splashed within a collection tank responsive to said movement of said battery-operated hand-held cleaning apparatus, the subquantity of fluid being a part of the quantity of fluid, said battery-operated, hand-held cleaning apparatus including an impeller, a collection tank having a porous filter in a top of a cathedral section of said collection tank and having a non-porous collection tank base, the non-porous collection tank base for collecting and retaining the quantity of fluid, and the porous filter in the top of the cathedral section for absorbing the subquantity of fluid, an exhaust vent, and an impeller motor sealingly separated from the impeller and from the collection tank, comprising the steps of:

spinning the impeller using the impeller motor to create suction;

forcibly intaking air using the suction created by the spinning impeller to create an unencumbered suction path;

exposing the quantity of fluid to the suction;

conveying the quantity of fluid into said battery-operated, hand-held cleaning apparatus along the unencumbered suction path directly toward the spinning impeller;

drawing the quantity of fluid directly into and through the spinning impeller;

collecting the quantity of fluid in the non-porous collection tank base, located beneath the impeller, the quantity of fluid moving downward and settling into the non-porous collection tank base responsive to gravity and air flow dynamics, the quantity of fluid being retained within the non-porous collection tank base without leakage until such time as the collection tank may be emptied, while venting the forcibly intaked air upward and through the exhaust vent; and absorbing the subquantity of fluid splashed during said movement of said battery-operated, hand-held cleaning apparatus using the porous filter in the top of the cathedral section of the collection tank.

7. A method of increasing suction strength for suctioning at least two ounces of liquid as a quantity of fluid from a surface into a hand-held cleaning apparatus, said hand-held cleaning apparatus powered by one of battery-power and AC power and including an impeller for generating suction, a deflector housing, a non-porous collection tank having a cathedral area above the non-porous collection tank, an exhaust vent in a top of the cathedral area, and a porous filter mounted to a bottom of the exhaust vent, comprising the steps of:

generating suction by spinning the impeller;

forcibly intaking air through an input attachment to create a direct suction path to said impeller;

exposing the quantity of fluid to the suction;

conveying the quantity of fluid into said hand-held cleaning apparatus along the direct suction path and into the impeller;

drawing the quantity of fluid directly through the impeller;

deflecting downward the quantity of fluid exiting an exhaust side of the impeller;

collecting and retaining the quantity of fluid in the non-porous collection tank, located beneath the impeller, the quantity of fluid moving downward and settling into the non-porous collection tank responsive to gravity and air flow dynamics; and venting air drawn into said hand-held cleaning apparatus through the porous filter mounted to the bottom of the exhaust vent.

8. A method of increasing suction strength for suctioning up to twelve ounces of liquid as a quantity of fluid from a surface into a hand-held cleaning apparatus powered by one of battery-power and AC current, said hand-held cleaning apparatus including an impeller for generating suction, an impeller motor for powering the impeller sealingly separated from said impeller, a deflector housing, a non-porous collection tank capable of retaining at least twelve ounces of liquid, an exhaust vent, and a porous filter mounted to a bottom of the exhaust vent, comprising the steps of:

generating suction by spinning the impeller using the impeller motor;

forcibly intaking air to create a direct suction path to said impeller;

exposing the quantity of fluid to the suction;

entraining the quantity of fluid in the forcibly intaked air as a plurality of entrained fluid particles;

conveying the plurality of entrained fluid particles into said hand-held cleaning apparatus along the direct suction path and into the impeller;

drawing the plurality of entrained fluid particles directly through the impeller;

de-entraining the plurality of entrained fluid particles through collision against the deflector housing to form a de-entrained quantity of fluid separate from the forcibly intaked air;

deflecting downward the de-entrained quantity of fluid and the forcibly intaked air exiting an exhaust side of the impeller to enter the non-porous collection tank;

collecting and retaining the de-entrained quantity of fluid in the non-porous collection tank, located beneath the impeller, the de-entrained quantity of fluid moving downward and settling into the non-porous collection tank responsive to gravity and air flow dynamics; and venting the forcibly intaked air drawn into the non-porous collection tank upward and through the exhaust.

9. A method of increasing suction intensity for suctioning up to twenty-four ounces of liquid as a quantity of fluid from a surface into a portable cleaning apparatus, and for retaining in a non-porous collection tank the quantity of fluid during back-and-forth movement of said portable cleaning apparatus without spillage, said portable cleaning apparatus including an intake attachment, an impeller having an intake side and an exhaust side, the non-porous collection tank, an exhaust vent on an upper surface of said portable cleaning device and having an inner side and an outer side, a porous filter mounted on the inner side of the exhaust vent, a deflection housing, and an impeller motor sealingly separated from the impeller and from the non-porous collection tank, comprising the steps of:

spinning the impeller using the impeller motor to create suction and thereby suctioning air to create a suction path;

placing the intake attachment of said portable cleaning apparatus over the quantity of fluid;

suctioning the quantity of fluid directly from the surface into the intake side of the spinning impeller and through the spinning impeller;

deflecting the quantity of fluid with the deflector housing on the exhaust side of the spinning impeller;

collecting and retaining the quantity of fluid in the non-porous collection tank, located beneath the spinning impeller, the quantity of fluid moving downward and settling into the non-porous collection tank responsive to gravity and air flow dynamics;

venting air suctioned into said portable cleaning apparatus upward through the exhaust vent; and capturing, using the porous filter, fluid particles entrained in the vented air.

10. The method as set forth in claim 7 or 8, further comprising the steps of:

moving said hand-held cleaning apparatus in a back and forth motion while exposing the quantity of fluid to the suction;

splashing, responsive to the back and forth motion, fluid collected in the non-porous collection tank as splashed fluid; and capturing the splashed fluid in the porous filter.

11. The method as set forth in claim 6 or 7, further comprising the steps of:

storing, without external leakage, the quantity of fluid collected in the non-porous collection tank, the quantity of fluid at least partially filling the non-porous collection tank;

detaching the non-porous collection tank;

pouring out the quantity of fluid; and re-attaching the non-porous collection tank to the hand-held cleaning apparatus.

12. The method as set forth in claim 7 or 8, with said hand-held cleaning apparatus including a spray nozzle, a spray pump, a cleaning fluid tank containing cleaning fluid, and a cleaning fluid hose, further comprising the steps of:

pumping, using the spray pump, the cleaning fluid from the cleaning fluid tank, through the cleaning fluid hose, to the spray nozzle;

dispensing the cleaning fluid onto the surface for cleaning; and exposing the cleaning fluid, with the quantity of fluid, to the suction.

13. A method of cleaning debris from a surface with a cleaning fluid by dispensing the cleaning fluid onto the surface and then suctioning the cleaning fluid and the debris from the surface as liquid debris into a portable, hand-held cleaning apparatus, and of retaining the liquid debris within said portable, hand-held cleaning apparatus without external leakage, said portable, hand-held cleaning apparatus including a vacuum nozzle, a spray nozzle, a spray pump, a cleaning fluid tank containing cleaning fluid, a cleaning fluid hose, an impeller having a plurality of blades, an impeller motor, a deflector housing, a non-porous collection tank detachedly connected to said portable, hand-held cleaning apparatus, and an exhaust vent, comprising the steps of:

pumping, using the spray pump, the cleaning fluid from the cleaning fluid tank, through the cleaning fluid hose, to the spray nozzle;

dispensing the cleaning fluid onto the surface having debris to be cleaned;

spinning the impeller using the impeller motor to create suction;

forcibly intaking air using the suction created by the spinning impeller to create a suction path;

suctioning the cleaning fluid and the debris from the surface into said portable, hand-held cleaning apparatus through the vacuum nozzle as liquid debris;

conveying the liquid debris inward along the suction path;

drawing the liquid debris directly into and through the impeller of said portable, hand-held cleaning apparatus;

deflecting, using the deflector housing, the liquid debris passing through the plurality of blades, the liquid debris moving downward responsive to gravity and air flow dynamics, while venting the forcibly intaked air upward and through the exhaust vent;

collecting the liquid debris in the non-porous collection tank, located beneath the deflector housing, at a bottom of said portable, hand-held cleaning apparatus, the liquid debris at least partially filling the non-porous collection tank;

detaching the non-porous collection tank;

pouring out the liquid debris; and reattaching the non-porous collection tank.

* * * * *